US006746300B1

(12) United States Patent
Matsukawa

(10) Patent No.: US 6,746,300 B1
(45) Date of Patent: Jun. 8, 2004

(54) TOY TOP

(75) Inventor: Hiroyuki Matsukawa, Tokyo (JP)

(73) Assignee: Takara Co., Ltd., Tokyo (JP)

( * ) Notice: Subject to any disclaimer, the term of this patent is extended or adjusted under 35 U.S.C. 154(b) by 0 days.

(21) Appl. No.: 10/428,715

(22) Filed: May 3, 2003

(30) Foreign Application Priority Data

Dec. 25, 2002 (JP) ..... 2002-375454

(51) Int. Cl.[7] ..... A63H 1/00
(52) U.S. Cl. ..... 446/256; 446/260
(58) Field of Search ..... 446/256, 259, 446/260, 262, 263, 264, 266, 257; 273/147; 473/588, 589

(56) References Cited

U.S. PATENT DOCUMENTS 1,025,299 A 5/1912 Pearsall et al.
1,509,436 A * 9/1924 Marx
1,559,232 A 10/1925 Esper
1,603,034 A 10/1926 Esper
2,435,445 A * 2/1948 Kerezi
4,233,774 A * 11/1980 Sahar ..... 46/82
5,827,107 A * 10/1998 Bears et al. ..... 446/263
6,083,076 A * 7/2000 Saint-Victor ..... 446/242
6,607,420 B2 * 8/2003 Chung ..... 446/235

FOREIGN PATENT DOCUMENTS

GB 2371496 7/2002
JP 9-38337 2/1997

* cited by examiner

*Primary Examiner*—Jacob K. Ackun
*Assistant Examiner*—Jamila Williams

(57) ABSTRACT

A toy top includes a toy body having a main spring power device therein, the main spring power device being rotatively linked with a revolving shaft provided on a center of a bottom surface of the toy body. The main spring power device includes latch means for maintaining a winding-up position when a main spring is wound up and a button for releasing the latch means so as to release a revolving force of the main spring. The toy body is provided with a press mechanism for pressing the button according to a rise or a reduction in a centrifugal force during the revolution of the toy body.

5 Claims, 13 Drawing Sheets

TOY TOP

BACKGROUND OF THE INVENTION

1. Field of the Invention

The present invention relates to a toy top in which a revolving speed is changed during revolution thereof.

2. Description of the Related Art

Conventionally, toy tops have been popular in children's playgrounds, and children often play a game in which they strike their toy tops against those of their companions so as to beat the companions' toy tops or drive out the toy tops of their companions from a game space or game board by means of their own toy tops. However, since such a simple game in which a toy top is revolved to be struck against companions' toy tops is merely decided by a player's force and skill, this game is not much fun. Therefore, toy tops having highly competitive characteristics are provided by adding such mechanisms that parts can be replaced and revolving characteristics change during the revolution of the toy top.

In these toy tops, a toy top having a mechanism in which revolving characteristics change during revolution is known (for example, see Japanese Patent Application Laid-Open Publication No. 2002-962).

However, since the above technique utilizes a wireless technique and requires a controller as well as a toy top, there arises a problem that it is fairly expensive and thus few children would get such a toy top.

SUMMARY OF THE INVENTION

The present invention has been made in order to solve the above problem.

Accordingly, it is an object of the present invention to provide a toy top which is capable of quickening a revolving speed at an initial revolving period, an end revolving period or an intermediate revolving period by means of a simple structure.

In accordance with the present invention, a toy top is provided. The toy top includes a toy body and a revolving shaft provided on a center of a bottom surface of the toy body so as to be rotatable. The toy top further includes a main spring power device arranged inside the toy body, the main spring power device being linked with the revolving shaft. Such construction permits the revolving shaft to be revolved by the force of the main spring, so that the revolving speed can be quickened during the revolution of the toy top.

In a preferred embodiment of the present invention, the main spring power device includes latch means for maintaining a winding-up position when a main spring is wound up and a button for releasing the latch means so as to release a revolving force of the main spring; and the toy body includes a press mechanism for pressing the button according to a change of a centrifugal force during revolution of the toy body. When the toy top revolves and the generated centrifugal force changes, the press mechanism operates to press the button of the main spring power device so that the latch means of the main spring power device is released, thereby releasing the wound-up main spring and transmitting its driving force to the revolving shaft. For this reason, the revolving force of the toy top increases, and the toy top abruptly starts to revolve more quickly. In such a manner, the revolving speed can be quickened during the revolution of the toy top by the simple structure without a controller, so that a player can enjoy a more fascinating game using the toy top, which game is not provided by a conventional toy top.

In a preferred embodiment of the present invention, the button protrudes to an outside of the main spring power device; and the press mechanism includes a press member for pressing the button by utilizing the centrifugal force generated due to the revolution of the toy body, the press member being arranged in a position which surrounds the main spring power device. The press member is kept separating from the button before the toy body revolves, and the button is pressed by the centrifugal force during the revolution of toy top. Therefore, before the toy top is initially revolved by the shooter or the like, it is not necessary to perform a special operation such as pulling out a certain part of the toy top against the spring, and thus, it is easy to operate the toy top.

In a preferred embodiment of the present invention, the press member is arranged so as to be movable in a direction where the press member presses or separates from the button, and is urged by a spring in a direction where the press member separates from the button, to thereby press the button against a force of the spring due to a rise of the centrifugal force during the revolution of the toy body. When the toy top revolves and the generated centrifugal force rises, the press mechanism operates so that the press member presses the button of the main spring power device and the latch means of the main spring power device is released, thereby releasing the wound-up main spring and transmitting its driving force to the revolving shaft. For this reason, the revolving force of the toy top increases, and the toy top abruptly starts to revolve more quickly. In such a manner, the revolving speed can be quickened during the revolution of the toy top with the simple structure without a controller, so that a player can enjoy a more fascinating game using the toy top, which game is not provided by a conventional toy top.

In a preferred embodiment of the present invention, the press member is arranged so as to be movable in a direction where the press member presses or separates from the button, and is urged by a first spring in the direction where the press member presses the button; and the press mechanism further includes a holding member which is arranged so as to be movable between a position where the holding member is engaged with the press member and a position where the holding member is disengaged from the press member, and which is urged by a second spring so as to be engaged with the press member in a state that the press member separates from the button, and which is moved to the position where the holding member is disengaged from the press member against the force of the second spring due to the centrifugal force during the revolution of the toy body, whereby the press member disengages from the holding member and presses the button with the force of the first spring due to a reduction in the centrifugal force during the revolution of the toy body. Though the engagement between the holding member and the press member is released due to the centrifugal force, the centrifugal force at the initial revolution of the toy top is so strong that the press member does not press the button. However, when the centrifugal force is reduced, the press member presses the button by the force of the spring. As a result, the revolving speed rises at the final period of the revolution of the toy top, and thus a unique toy top can be provided.

In a preferred embodiment of the present invention, the revolving shaft includes a ring portion formed to have a larger size than the toy body. In this embodiment, the main spring of the toy body is wound up, and when the toy top is revolved by a suitable shooter or the like, simultaneously the main spring may be released. Although the toy top revolves about the revolving shaft, simultaneously the revolving shaft itself revolves due to the release of the main spring. However, since the ring portion having a larger size than the toy body is mounted to the revolving shaft, the revolving shaft cannot revolve immediately at high speed due to the flywheel effect of the ring portion. The revolution of the revolving shaft is quickened gradually. Moreover, since the inertial force is exerted on the revolving shaft, the revolution of the toy top is in no hurry to stop. For this reason, revolving characteristics can be such that when the revolving shaft revolves, the revolving speed of the toy body also rises, but a degree of the rise is slow, and the revolving force of the toy top increases gradually and the revolution is long-lasting due to the inertia. Therefore, the revolving speed rises at the intermediate period of the revolution, and thus a unique toy top can be provided.

In addition, when the toy top as well as another toy top are revolved and are struck against each other on the game board, since the ring portion of the toy top has a larger size than the toy body, the competitor's toy top strikes against the ring portion, thereby strengthening the force with which the competitor's toy top is flicked away or knocked over. Moreover, since the ring portion is larger than the toy body, the flywheel effect on the toy body is enhanced.

BRIEF DESCRIPTION OF THE DRAWINGS

Other objects and many of the attendant advantages of the present invention will be readily appreciated as the same becomes better understood by reference to the following detailed description when considered in connection with the accompanying drawings; wherein.

DETAILED DESCRIPTION OF THE INVENTION

Embodiments of the present invention will be explained below with reference to the drawings.

Referring first to FIGS. 1 to 7, a toy top according to an embodiment of the present invention is illustrated. The toy top of this embodiment includes a toy body A which is composed of a lower body member 1 arranged at a bottom thereof, an intermediate body member 2 arranged on the lower body member 1, and an upper body member 3 arranged on the intermediate body member 2. The intermediate body member 2 is a weight made of metal. A revolving shaft 4 is provided on a center of the lower body member 1. The upper body member 3 and the lower body member 1 are made of synthetic resin.

A basic structure of the toy body A of the toy top having the above multi-layer structure is publicly known, and its assembly and disassembly are carried out in a publicly known manner. The toy top may have a three or more layer structure using three or more body members. Complicated revolving characteristics can be obtained by replacing respective body members.

Figure 3A:
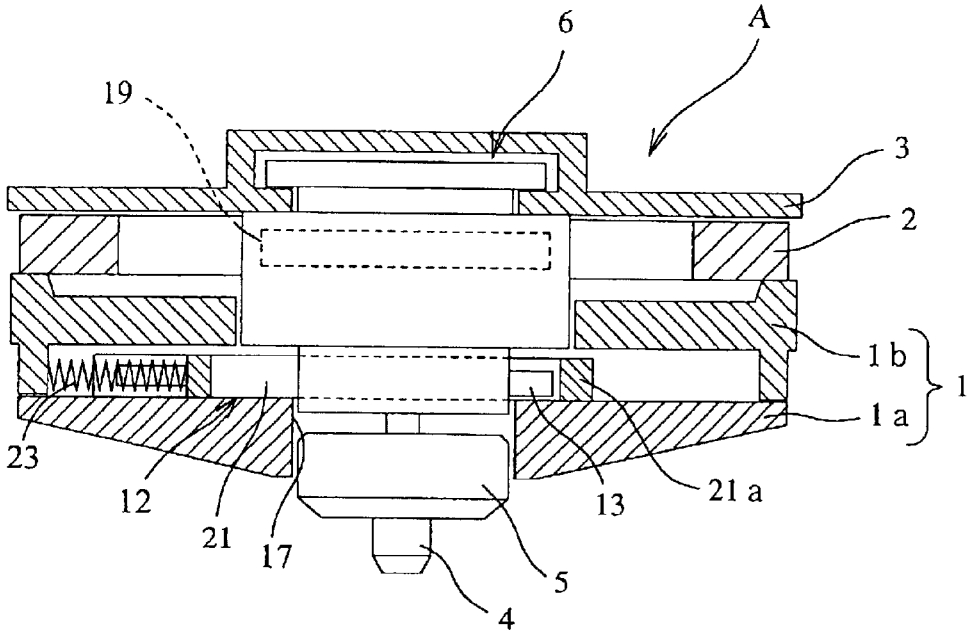
FIGS. 3A and 3B are elevational sectional views showing states before and after an operation of press members, respectively.
Figure 3B:
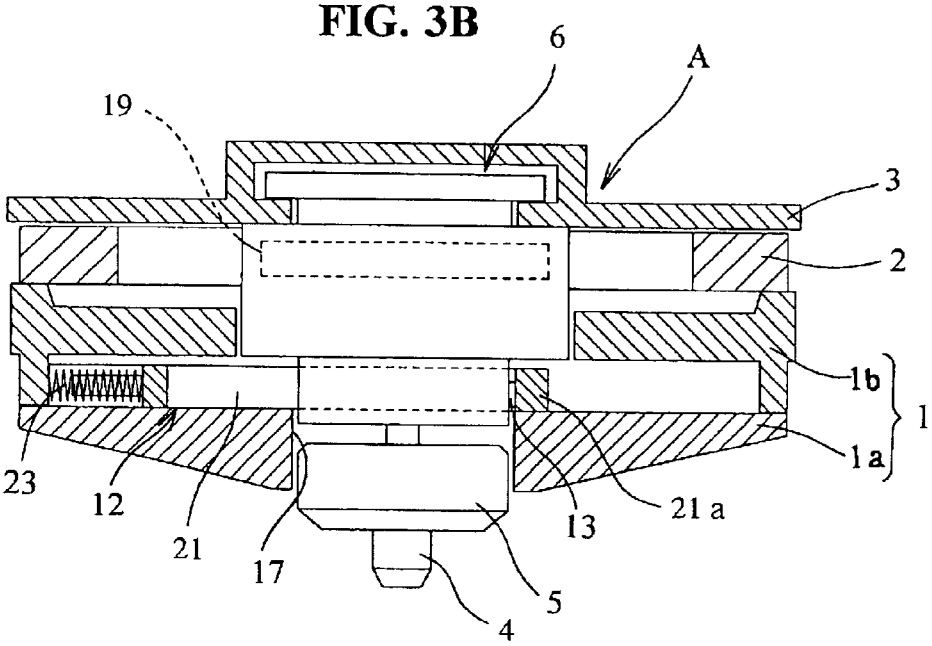
Figure 4A:
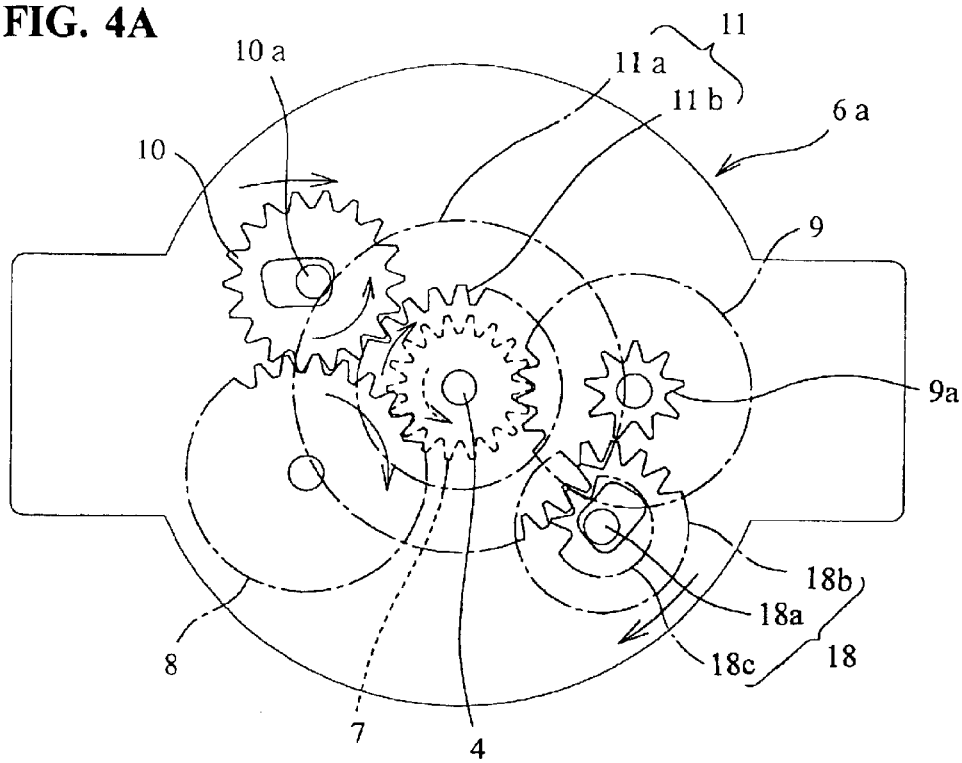
FIGS. 4A and 4B are plan views showing states during a winding operation of a main spring power device and an unwinding operation thereof, respectively.
Figure 4B:
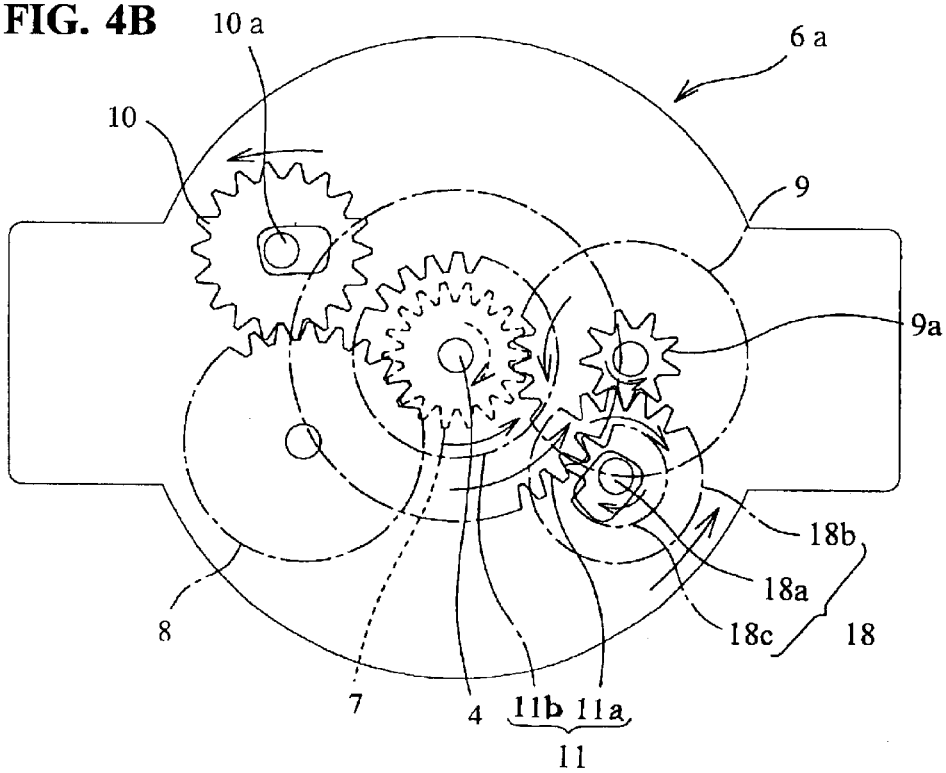

A cylindrical weight 5 made of metal is fixed to the revolving shaft 4 which protrudes from a center of a bottom surface of the lower body member 1. The revolving shaft 4 is rotatively linked with a main spring power device 6 arranged in the center of the toy body A. The main spring power device 6 is provided with the revolving shaft 4 on a center of a device body 6*a* rotatively as shown in FIGS. 4A and 4B, and is provided with an input gear 8 and an output gear 9 which are engaged with a shaft gear 7 on a base portion of the revolving shaft 4. Further, a first intermediate gear 10, which is movable so that a shaft 10*a* approaches to or separates from the center of the device body 6*a*, is arranged to mesh with the input gear 8. The first intermediate gear 10 is movable so as to be capable of being engaged with and disengaged from a drive gear 11 separately provided coaxially with the revolving shaft 4. The drive gear 11 includes a large diameter gear 11*a* and a small diameter gear 11*b* which are integrally formed. Moreover, a claw (not shown) protrudes from a center of the drive gear 11, and the claw is engaged with an end portion on a central side of a main spring 19 (see FIG. 3) arranged in the device body 6*a*. The other end of the main spring 19 is fixed to the device body 6*a*. When the input gear 8 revolves clockwise as shown in FIG. 4A, the first intermediate gear 10 moves so as to be engaged with the small diameter gear 11*b* of the drive gear 11 provided coaxially with the revolving shaft 4. On the contrary, when the input gear 8 revolves counterclockwise, the first intermediate gear 10 moves so as to be disengaged from the small diameter gear 11*b* of the drive gear 11 as shown in FIG. 4B.

The output gear 9 is engageably linked with the large diameter gear 11*a* of the drive gear 11 via a second intermediate gear 18. The second intermediate gear 18 is movable so as to be capable of being engaged with and disengaged from a small diameter gear 9*a* formed integrally with the output gear 9 according to a revolving direction of the drive gear 11. The second intermediate gear 18 includes a shaft 18*a*, a large diameter gear 18*b* and a small diameter gear 18*c* which are formed integrally. The second intermediate gear 18 is so arranged that the small diameter gear 18*c* thereof meshes with the large diameter gear 11*a* of the drive gear 11 and the large diameter gear 18*b* of the second intermediate gear 18 is adapted to be disengageably engaged with the small diameter gear 9*a* of the output gear 9. When the drive gear 11 revolves counterclockwise as shown in FIG. 4B, the second intermediate gear 18 moves so that the large diameter gear 18*b* thereof is engaged with the small diameter gear 9*a* of output gear 9. On the contrary, when the drive gear 11 revolves clockwise, the second intermediate gear 18 moves so that the large diameter gear 18*b* thereof is disengaged from the small diameter gear 9*a* of the output gear 9 as shown in FIG. 4A.

Figure 5A:
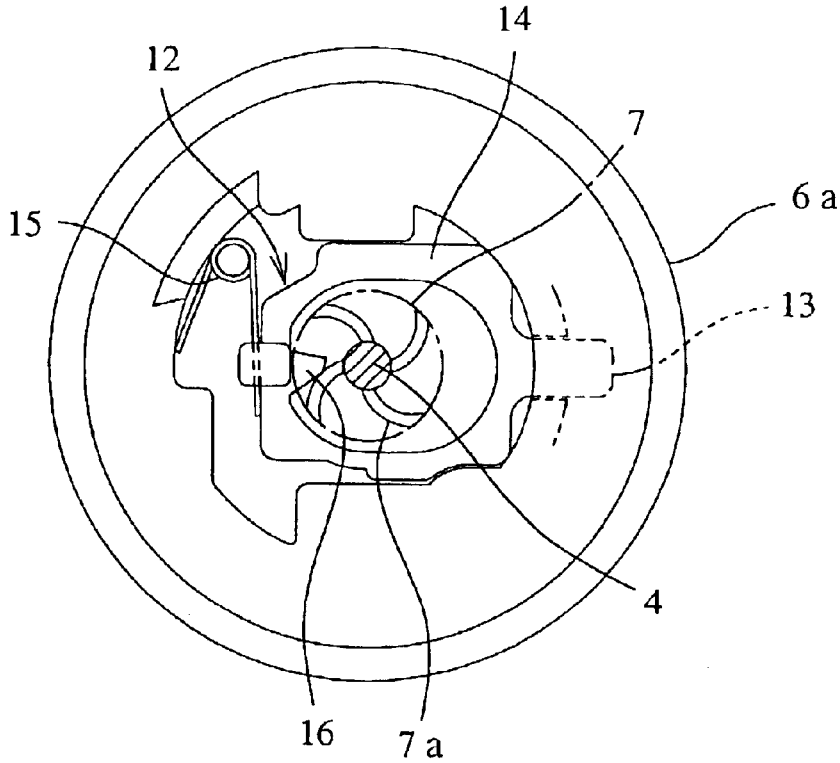
FIGS. 5A and 5B are plan views showing states before and after an operation of a latch release button, respectively.
Figure 6A:
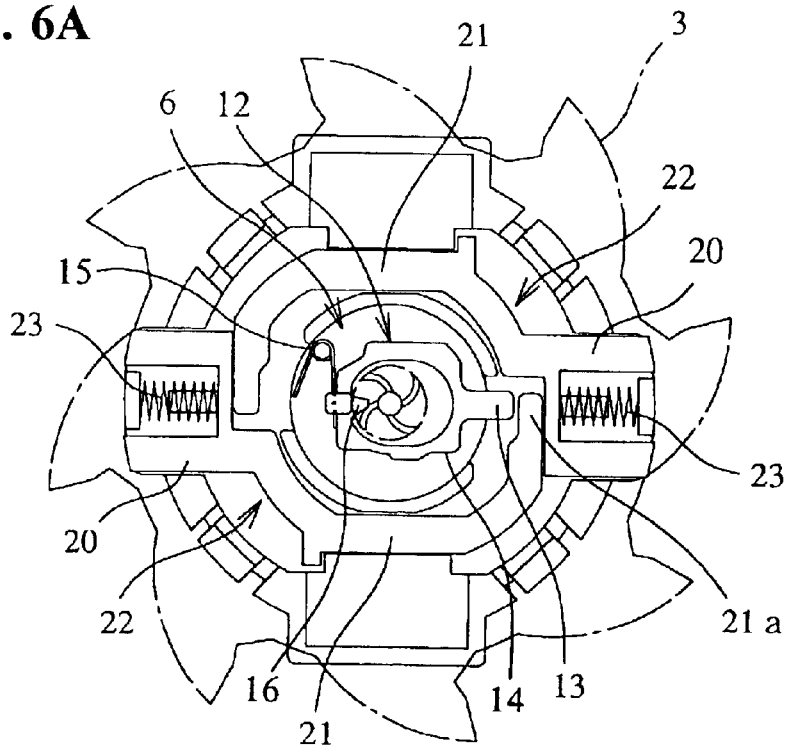
FIGS. 6A and 6B are plan views showing states before and after an operation of the press members, respectively.

As shown in FIGS. 5A and 6A, the main spring power device 6 is provided with latch means 12 which latches a ratchet 7*a* formed on a rear side of the shaft gear 7 of the revolving shaft 4, and a latch release button 13 for releasing the latch. Namely, the latch means 12 is composed of a latch ring 14 having an oval shape arranged around the ratchets 7*a*, and a spring 15 which urges the latch ring 14 in a certain direction. A pawl 16 which can be latched on the ratchets 7*a* is formed on an inner side of one end of the latch ring 14. When the ratchets 7*a* revolve in a winding direction of the main spring, the pawl 16 is not latched on the ratchet 7*a*, and when the ratchets 7*a* revolve in the opposite direction, the pawl 16 is latched on the ratchet 7*a*. The spring 15 urges the latch ring 14 so that the pawl 16 engages with the ratchet 7*a*. The latch release button 13 is provided protrusively on an outer side of the other end of the latch ring 14, and a distal end thereof protrudes to an outside of the main spring power device 6.

Figure 5B:
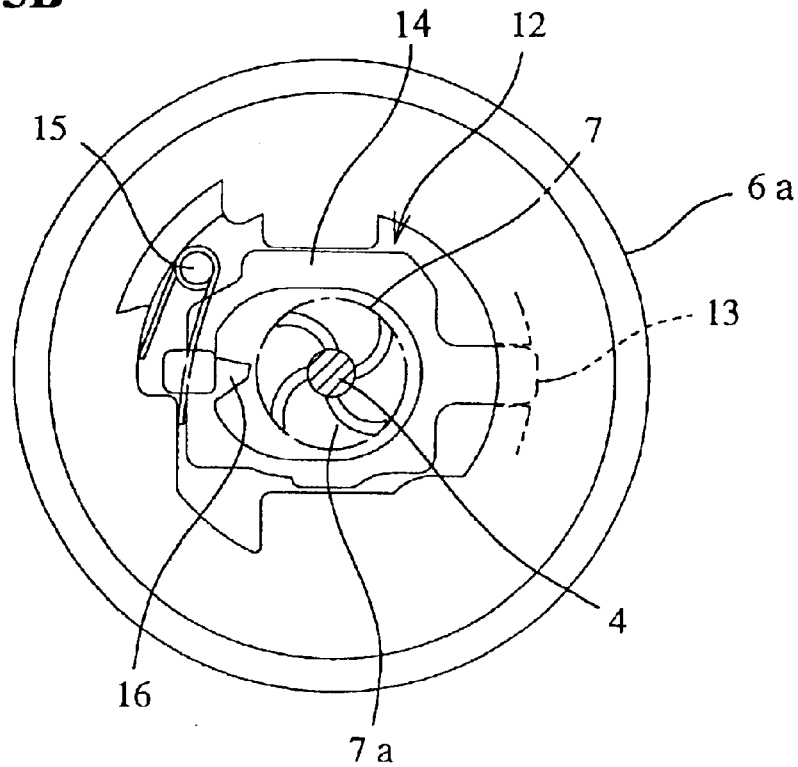
Figure 6B:
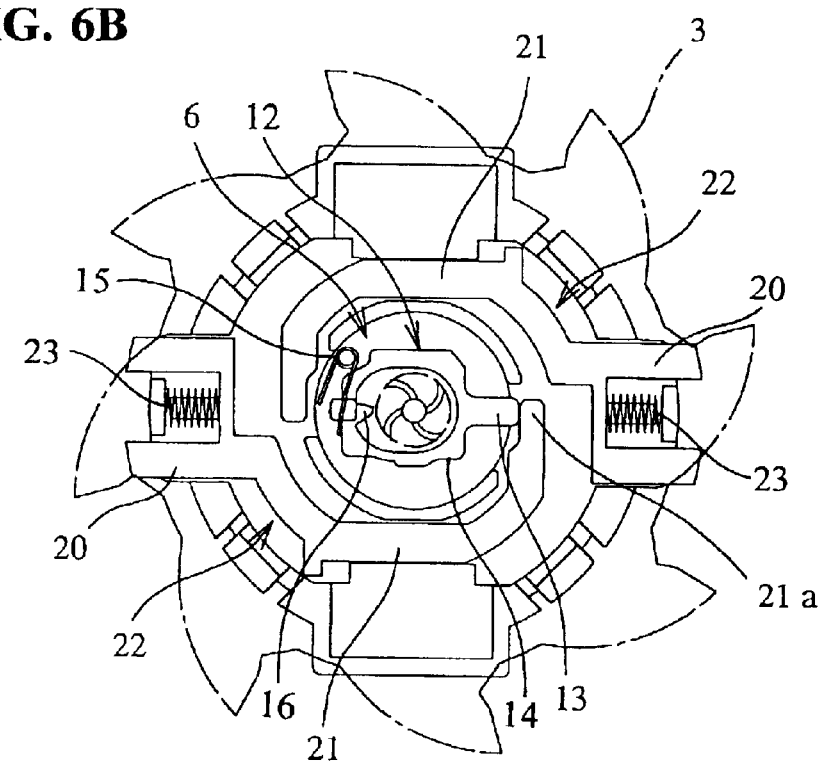

According to the above structure, as shown in FIGS. 5A and 6A, when the pawl 16 of the latch ring 14 is latched on the ratchet 7*a* by the spring 15, a winding-up position at the time of winding up the main spring 19 is maintained, and when the latch release button 13 is pressed as shown in FIGS. 5B and 6B, the latch ring 14 moves so as to release the latch between the pawl 16 and the ratchet 7*a* and a revolving force of the main spring 19 is released.

Figure 1:
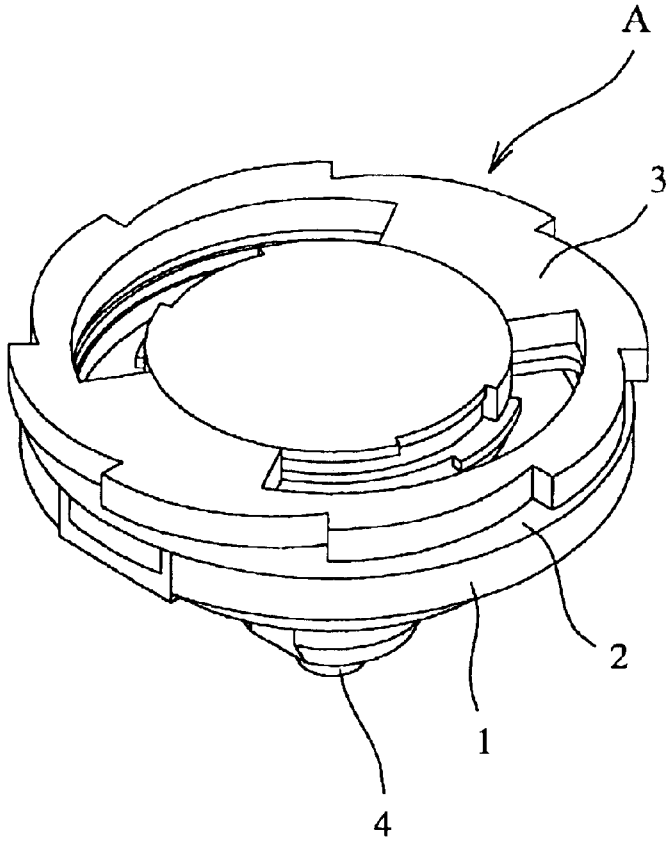
FIG. 1 is a perspective view showing an embodiment of a toy top of the present invention.
Figure 2:
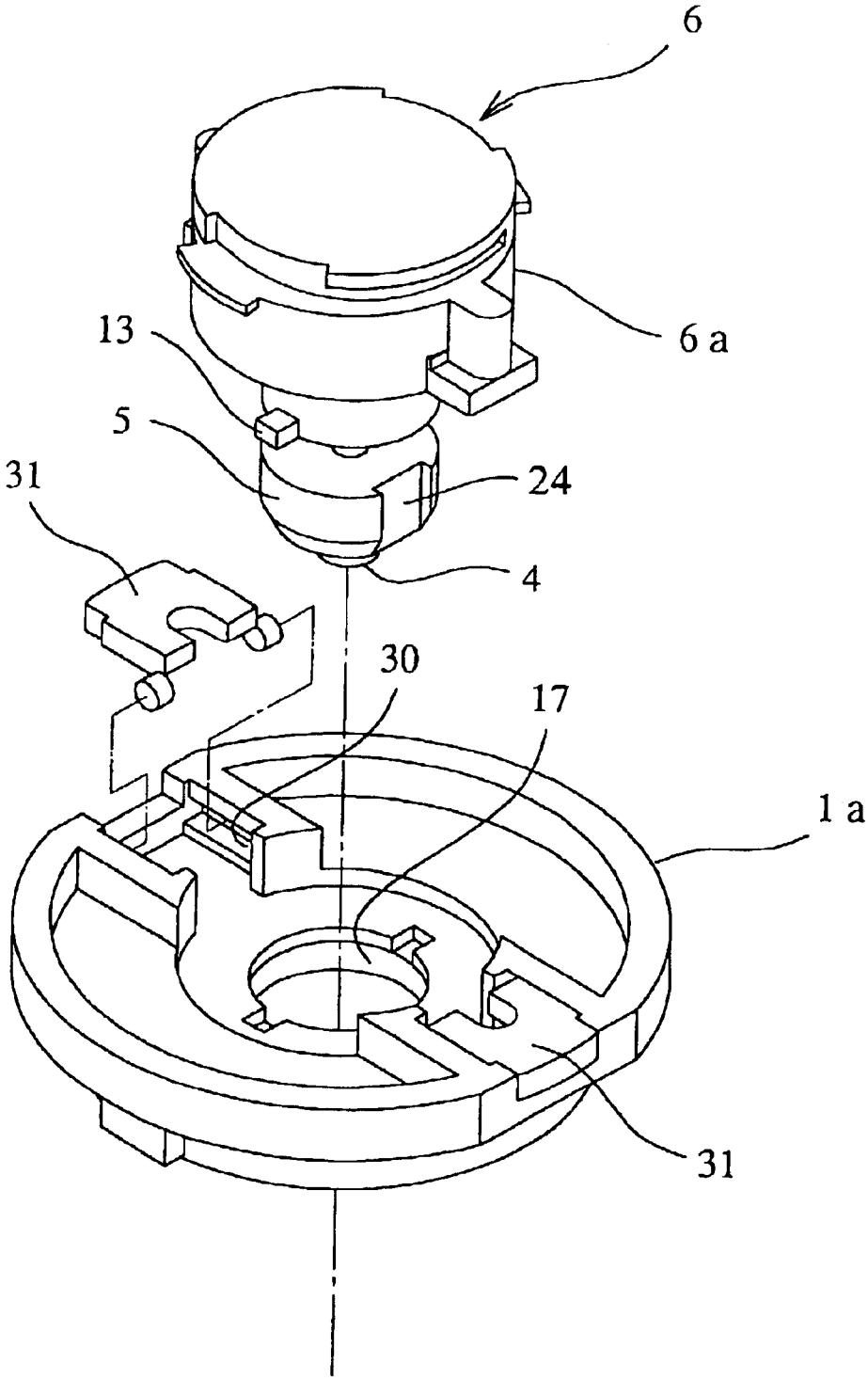
FIG. 2 is an exploded perspective view of essential part of the toy top.

A press mechanism for pressing the button 13 in the case where a centrifugal force during revolution of the toy top is not less than a certain value is provided on the lower body member 1 of the toy body A. Namely, the lower body member 1 is constituted of a lower element 1*a* and an upper element 1*b* so that the upper and lower elements 1*b* and 1*a* are capable of being separated from and combined with each other as shown in FIGS. 2, 3A and 3B. A circular hole 17 (see FIG. 2) is formed on a center of the lower element 1*a* of the lower body member 1. Moreover, the main spring power device 6 is fixed by fasteners 31 which are rotatively and slidably provided in opposed sliding recesses 30 on the upper surface of the lower element 1*a* of the lower body member 1. As shown in FIGS. 6A and 6B, an inside of the lower body member 1 is provide with a pair of opposed press members 22 which are each constituted of a U-shaped element 20 and an approximately semicircular crook 21 protruding from an end of a back surface of the U-shaped elements 20. The press members 22 are each provided at a distal end of the crook 21 with an engagement portion 21*a* and are arranged so that the engagement portion 21*a* of one of the press members 22 faces the button 13. Compression springs 23 are mounted to the insides of the U-shaped elements 20, respectively. One of the paired press members 22 is actually used for latch release. The other one is provided for balance and for convenience of mounting of the main spring power device 6 (the position of the latch release button may face either direction). Moreover, the press members 22 are movable in a diameter direction of the circular hole 17, and the press members 22 are each normally urged by the spring 23 so that the engagement portion 21*a* at the distal end of the crook 21 is in a position where it separates from the center of the circular hole 17. As a result, one of the engagement portions 21*a* is arranged so as to be movable in a direction where it presses or separates from the button 13, and as show in FIGS. 3A, 5A and 6A, the engagement portion 21*a* is normally urged in the direction where it separates from the button 13, so as to be capable of pressing the button 13 against the force of the spring 23 by means of a centrifugal force during the revolution of the toy body A.

Figure 7:
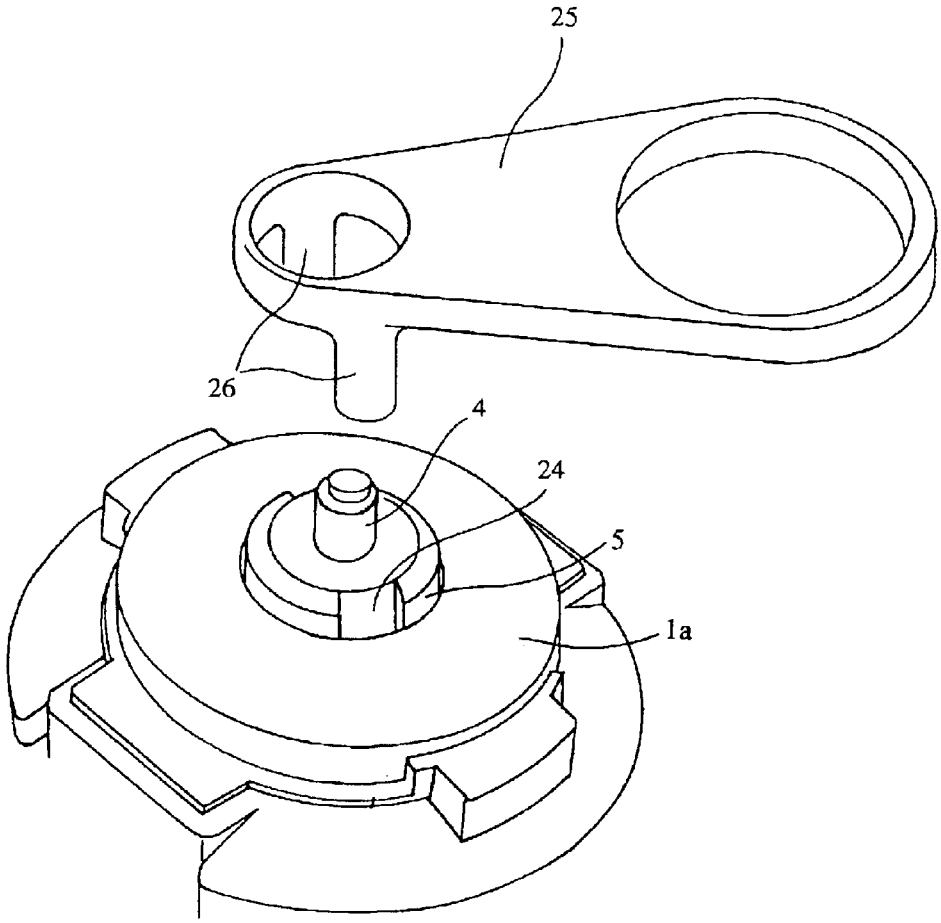
FIG. 7 is a perspective view showing a main section of the toy top, wherein a revolving operation of a revolving shaft is carried out with a winding tool.
Figure 8:
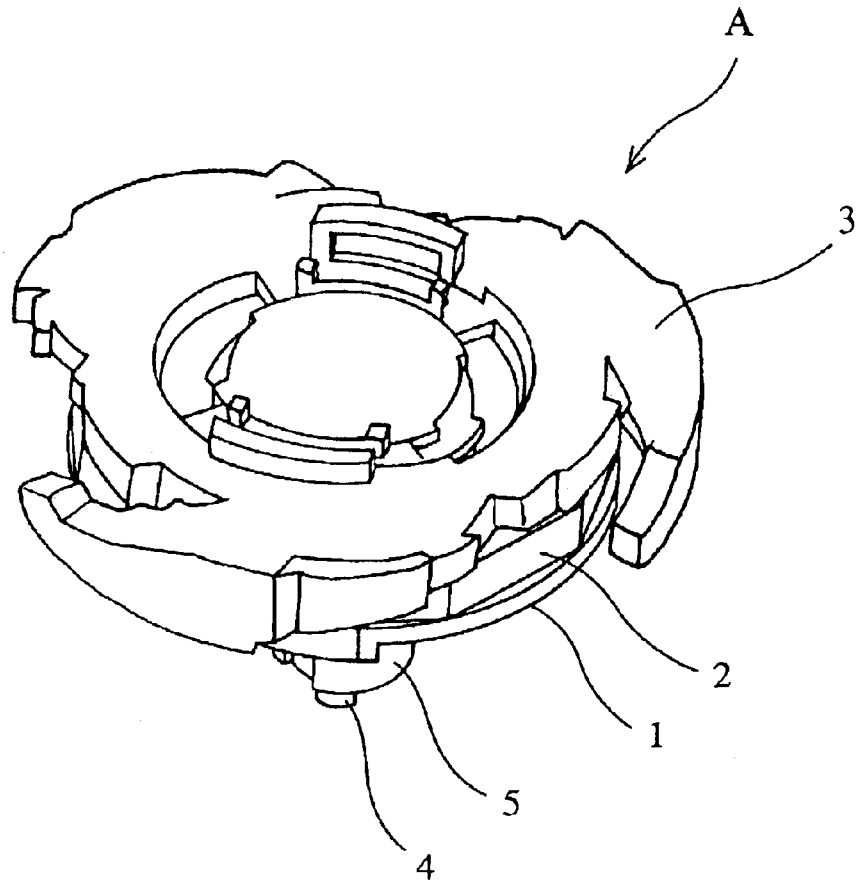
FIG. 8 is a perspective view showing another embodiment of the toy top of the present invention.

The weight 5 on the revolving shaft 4 is formed on opposite sides thereof with engagement grooves 24 extending in a vertical direction as shown in FIG. 7. A pair of legs 26 formed at a distal end of a winding tool 25 are engaged with the engagement grooves 24 so that the revolving shaft 4 can be revolved by revolving the winding tool 25. When the revolving shaft 4 revolves, as shown in FIG. 4A, the input gear 8 and the output gear 9 of the main spring power device 6 which are engaged with the shaft gear 7 also revolve. When the input gear 8 revolves, the first intermediate gear 10 moves so as to be engaged with the small diameter gear 11*b* of the drive gear 11, so that the drive gear 11 is revolved, whereby the main spring 19 linked with the drive gear 11 is wound up. However, since the large diameter gear 18*b* of the second intermediate gear 18 is disengaged from the small diameter gear 9*a* formed on the output gear 9 due to this revolving direction of the drive gear 11, the output gear 9 idles. When the ratchets 7*a* revolve in the main spring winding-up direction, the pawl 16 of the latch means 12 is not latched on the ratchet 7*a*, so that the revolving shaft 4 can revolve. However, even when the winding tool 25 is removed after the main spring 19 is wound up, the pawl 16 is latched on the ratchet 7*a* by the spring 15, so that the revolving shaft 4 does not revolve and the state in which the main spring 19 is wound up is maintained.

When the toy top is revolved by a shooter (not shown), a centrifugal force is exerted upon the toy top. The engagement portion 21*a* of the press member 22 is normally urged in the direction where it separates from the button 13, but when the centrifugal force rises after starting of the revolution, as shown in FIGS. 3B, 5B and 6B, since this strong centrifugal force moves the press member 22 of the press mechanism against the force of spring 23 in the U-shaped element 20, an inner side surface of the engagement portion 21*a* at the distal end of the crook 21 presses the latch release button 13 of the main spring power device 6. As a result, the pawl 16 of the latch means 12 is unlatched from the ratchet 7*a* formed on the shaft gear 7 of the revolving shaft 4, and thus, as shown in FIG. 4B a driving force of the main spring 19 is transmitted to the revolving shaft 4 via the drive gear 11, the second intermediate gear 18, the output gear 9 and the shaft gear 7. For this reason, the revolving shaft 4 revolves roundly. The toy top itself revolves, but since a revolving force of the revolving shaft 4 is applied to the revolving toy top, the revolving speed of the toy top abruptly rises during the revolution (at an initial stage of the revolution) so that the toy top abruptly revolves quickly. The application of this revolving force continues until the main spring 19 is completely unwound. When the driving force of the main spring 19 is transmitted to the revolving shaft 4 via the drive gear 11, the second intermediate gear 18, the output gear 9 and the shaft gear 7, the first intermediate gear 10 on an input side is disengaged from the drive gear 11 as shown in FIG. 4B, and thus the input gear 8 idles.

According to the toy top having the above structure, when two players revolve the respective toy tops on a concave surface of a game board with a recessed center by means of suitable shooters or the like, the toy tops revolve about the respective revolving shafts 4, and the toy bodies A strike against each other. At this time, there is a strong possibility that a player having a toy top with a stronger revolving force will win the game. It is important that the revolving force has increased before the toy tops strike against each other, but the operation of the press member 22 is determined mainly by the revolution of the toy top and the forces of the springs 23 and 15. In general, since the spring forces of the individual springs have minute deviations, the toy tops do not obtain an increased revolving force simultaneously, and thus the game is not decided by a player's force and skill. When a player uses a toy top in which the revolving force increases at the initial revolving of the toy top, an outcome of the game is decided in favor of such a player in the case of striking of the toy tops occurring early in revolution, and this cannot be decided by a player's force and skill. Therefore, the game using the toy top which is more fascinating than a conventional game can be played.

Referring now to FIGS. 8 to 10C, another embodiment of the present invention is illustrated. In this embodiment, when the centrifugal force during the revolution of the toy top is lowered, the revolution of the toy top is quickened. The toy top of this embodiment has the structure similar to that in FIGS. 2, 4A, 4B, 5A and 5B.

In this embodiment, the lower body member 1 of the toy body A is provided with the press mechanism for pressing the button 13 in the case where the centrifugal force during the revolution of the toy top is lowered. Namely, as shown in FIGS. 9A, 9B, 10A, 10B and 10C, a pair of press members 32 and a pair of holding members 33 are arranged on straight lines crossing perpendicularly to each other at the center of the circular hole 17 formed on the lower element 1*a* of the lower body member 1 so as to be opposed to each other.

The press members 32 are each formed to have a box shape and are each provided with a spring 34*a* therein. One end of the spring 34*a* is engaged with an upright element 35 on a peripheral edge of the lower element 1*a* of the lower body member 1, thereby arranging the press members 32 movable in the direction in which one of the press members 32 presses or separates from the button 13. The press members 32 are urged by the respective springs 34*a* in the directions where one of the press members 32 presses the button 13. Both sides of ends of the press members 32 near the circular hole 17 protrude laterally outward. Moreover, outside portions of the press members 32 protrude to an outside of the toy body A so that the press members 32 can be moved by pulling the outside portions thereof outward.

A branch engagement leg 33*a* is formed on each of the holding members 33, and the branch engagement leg 33*a* is arranged so as to be movable to a position in which it is engaged with the press members 32 (a position closer to the center of the circular hole 17) and a position in which it is disengaged from the press members 32 (a position separated from the center of the circular hole 17). The holding members 33 are normally urged by respective springs 34*b* so that the press members 32 are engaged with the branch engagement legs 33*a* of the holding members 33 in a state that one of the press members 32 is separated from the button 13, and the holding members 33 are moved to the positions where the engagement state is released against the force of the springs 34*b* by the centrifugal force during the revolution of the toy body A.

In order to revolve the revolving shaft 4, the main spring 19 may be wound up by the winding tool 25 in the manner shown in FIG. 7.

Figure 9A:
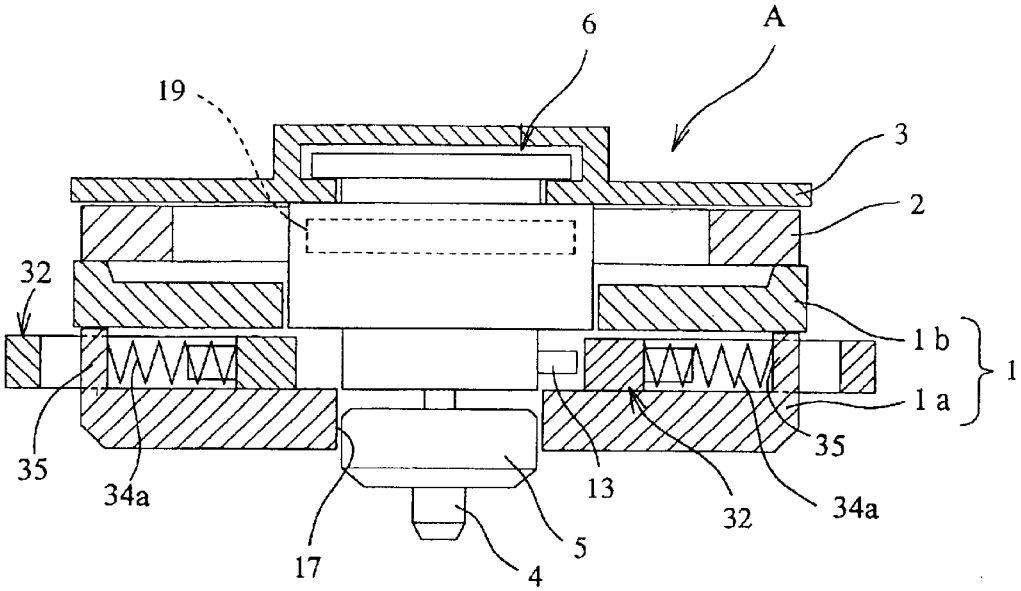
FIGS. 9A and 9B are plan views showing states before and after an operation of the latch release button.
Figure 9B:
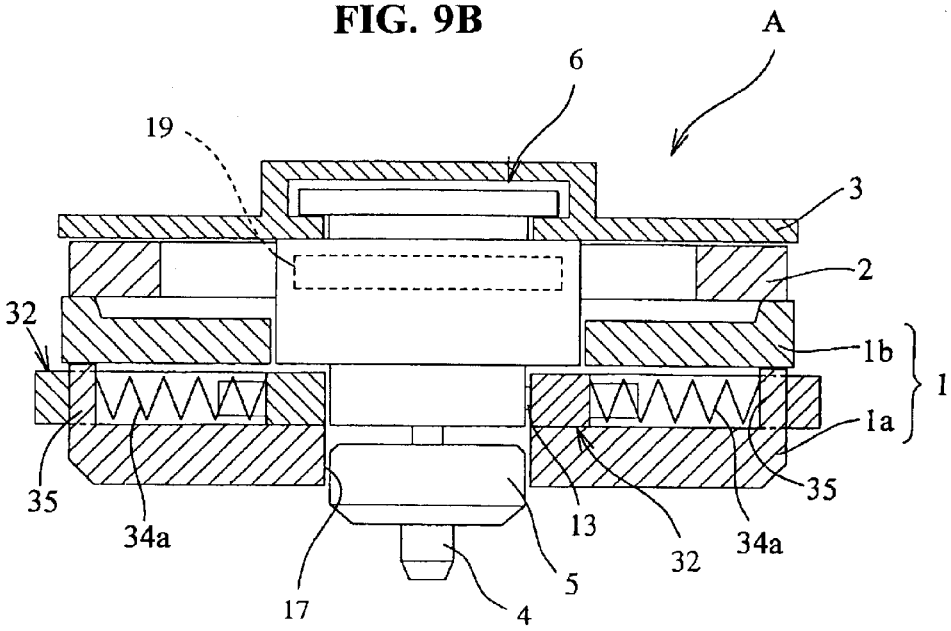
Figure 10A:
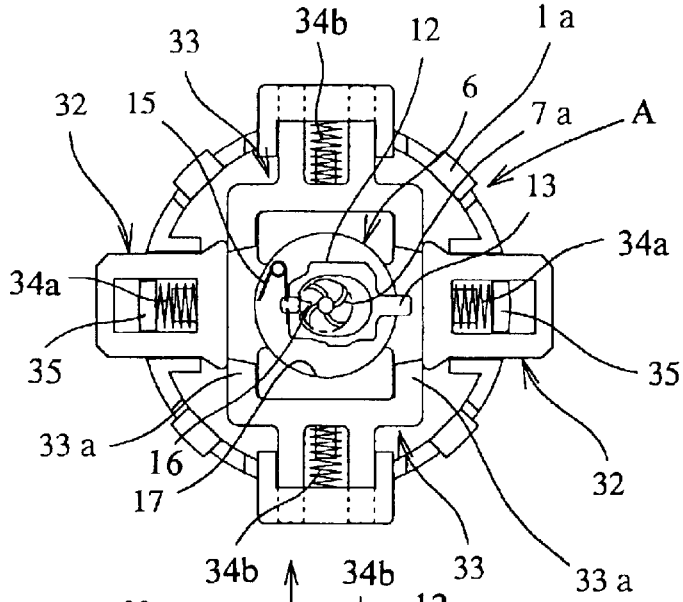
FIGS. 10A, 10B and 10C are plan views showing states before, during and after an operation of the press members.
Figure 10B:
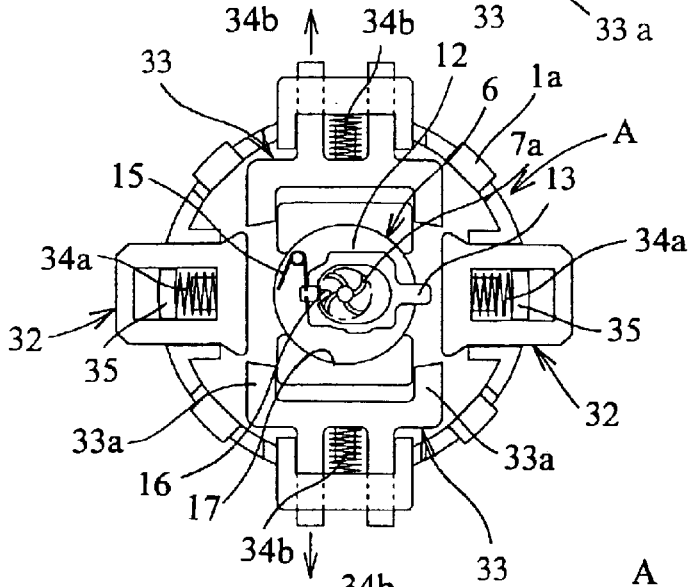
Figure 10C:
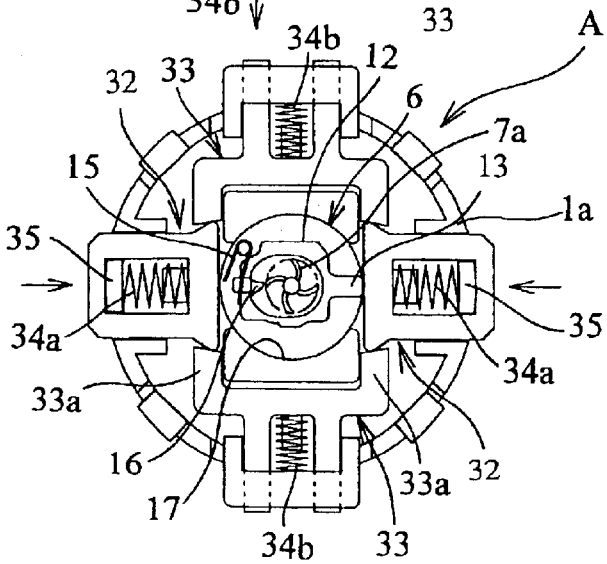
Figure 11:
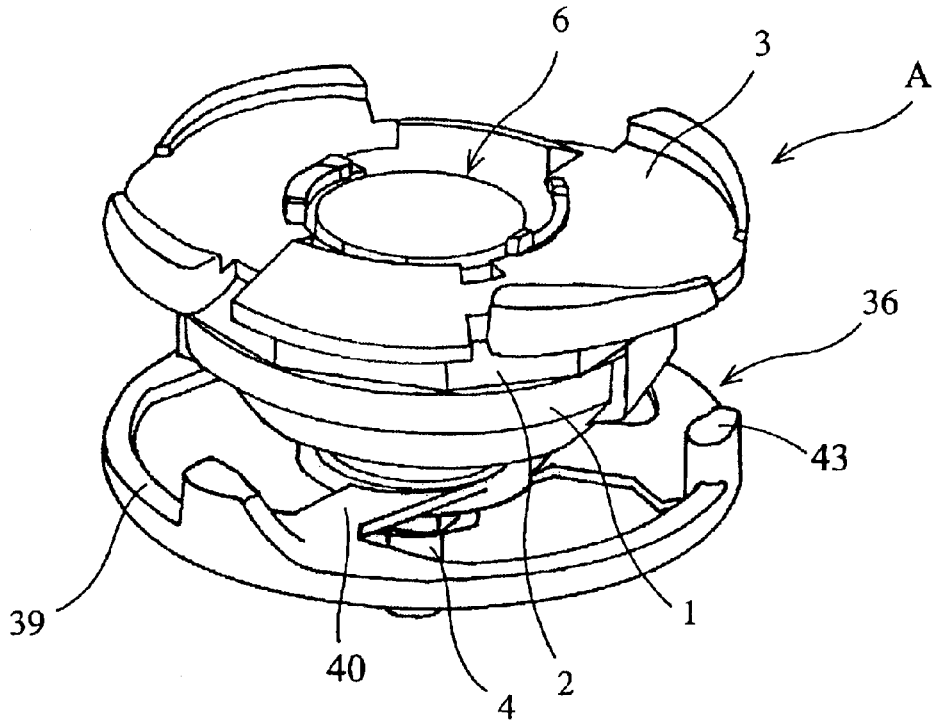
FIG. 11 is a perspective view showing still another embodiment of the toy top of the present invention.

As shown in FIG. 10A, the outside portions of the press members 32 are pulled outward against the springs 34*a* so as to be separated from the latch release button 13. At this time, the holding members 33 are moved to the positions where the engagement legs 33*a* thereof are engaged with the press members 32 by the springs 34*b*. When the toy top is revolved by the shooter (not shown), the centrifugal force is exerted upon the toy top. As a result, as shown in FIGS. 9B and 10B, the holding members 33 move away from the center of the circular hole 17 against the force of the respective springs 34*b*, so that the engagement between the holding members 33 and the press members 32 is released. For this reason, the press members 32 can be moved by the force of the respective springs 34*a* in the direction where one of the press members 32 presses the latch release button 13. However, since the centrifugal force is exerted also on the press members 32, the press members 32 cannot be moved by the force of the springs 34 while the centrifugal force is strong. However, when the revolving speed of the toy body A reduces and thus the centrifugal force is lowered so that the force of the springs 34*a* becomes relatively stronger, the press members 32 are moved by the spring force, and as shown in FIGS. 4B, 9B and 10C, one of the press members 32 presses the latch release button 13. As a result, the pawl 16 of the latch means 12 is separated from the ratchet 7*a* of the revolving shaft 4, so that the driving force of the main spring 19 is transmitted to the revolving shaft 4 via the drive gear 11, the second intermediate gear 18, the output gear 9 and the shaft gear 7 as shown in FIG. 4B. For this reason, the revolving shaft 4 revolves roundly. Although the toy top itself revolves, the revolving force of the revolving shaft 4 is applied to the revolving toy top, so that the revolving speed of the toy top again rises during the revolution (at a final stage of the revolution) and the toy top abruptly starts to revolve quickly. The revolving force continues to act until the main spring 19 is unwound completely. When the driving force of the main spring 19 is transmitted to the revolving shaft 4 via the drive gear 11, the second intermediate gear 18, the output gear 9 and the shaft gear 7, the first intermediate gear 10 on the input side separates from the drive gear 11, and thus the input gear 8 idles.

According to the toy top having the above structure, when two players each revolve the toy tops on the concave surface of the game board with a recessed center by means of suitable shooters or the like, the toy tops revolve about the respective revolving shafts 4, and the toy bodies A strike against each other. In this instance, as described above, there is a strong possibility that a player having a toy top with a stronger revolving force will win the game, but an outcome of the game is not decided by a player's force and skill. When a player uses a toy top in which the revolving force increases at the final revolution period of the toy top, an outcome of the game is decided in favor of such a player in the case of striking of the toy tops occurring late in revolution, and this cannot be decided by a player's force and skill. Therefore, the game using the toy top which is more fascinating than a conventional game can be played.

Referring to FIGS. 11 to 13B, still another embodiment of the present invention is illustrated, wherein the revolving speed of the toy top is quickened at an intermediate period of the revolution thereof. The toy top of this embodiment also has the main spring power device 6 shown in FIGS. 4A and 4B. In this case, the latch release means shown in FIGS. 5A and 5B is unnecessary.

The revolving shaft 4 which protrudes from the bottom center of the lower body member 1 is rotatively linked with the main spring power device 6. A rotating body 36 is fixed to the revolving shaft 4.

Figure 12:
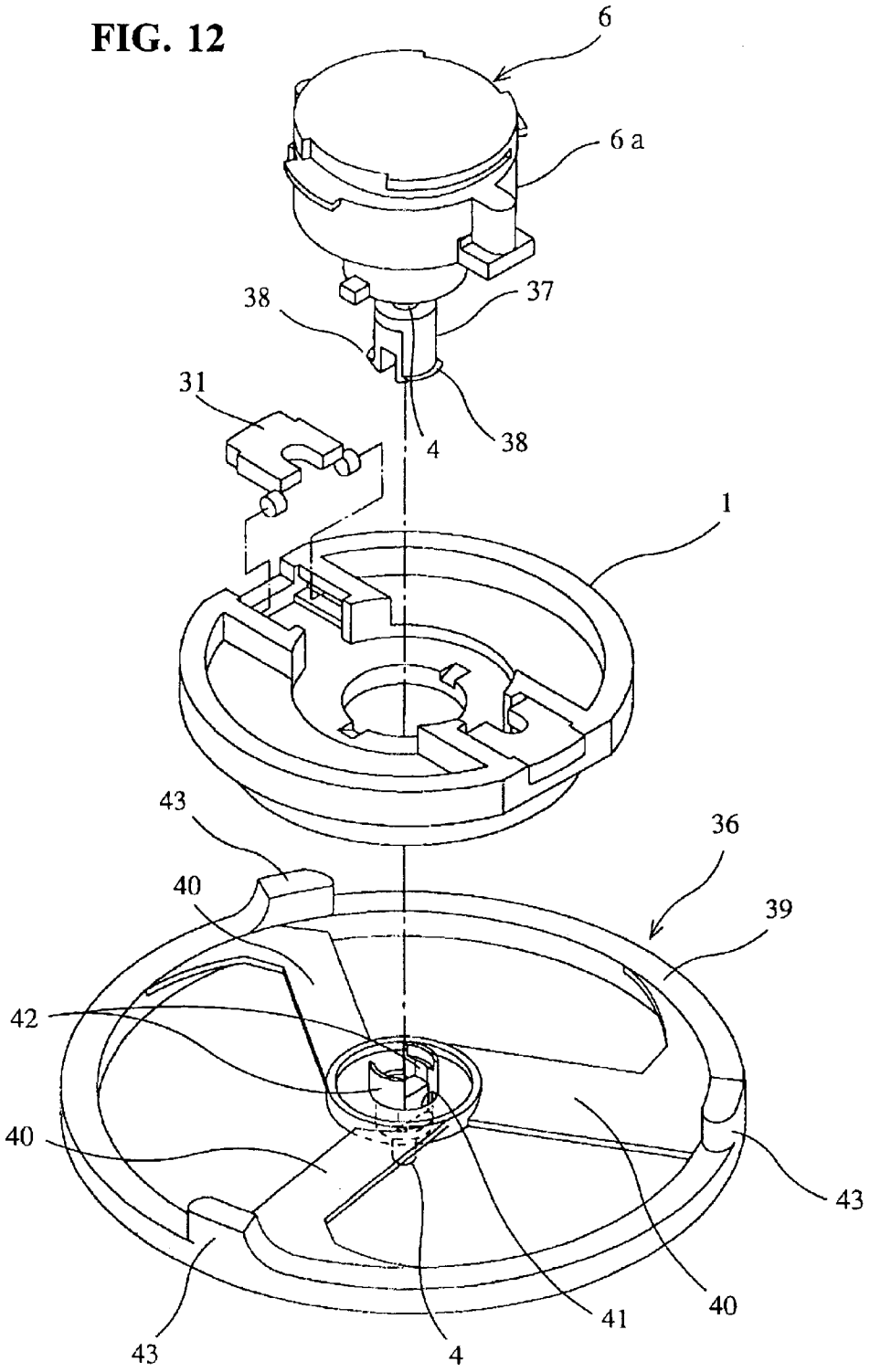
FIG. 12 is an exploded perspective view of a main section of the toy top.

Namely, as shown in FIG. 12, a branch engagement element 37 is formed on an end of the revolving shaft 4. Fixing flanges 38 are formed on a distal end of the engagement element 37. The rotating body 36 is detachably mounted on the engagement element 37. The rotating body 36 has a ring portion 39 formed to have a size larger than the toy body A so that the rotating body 36 gradually raises the revolving speed of the revolving shaft 4. Namely, the rotating body 36 is composed of a center portion, the ring portion 39 and blade portions 40 which connect the center portion and the ring portion 39. The center portion is formed with a pair of through holes 41 through which the branch engagement element 37 can be inserted and a pair of supporting elements 42 so as to opposed to each other with respect to a revolving center. An upper surface of the ring portion 39 is formed with protrusions 43 at predetermined intervals.

Figure 13A:
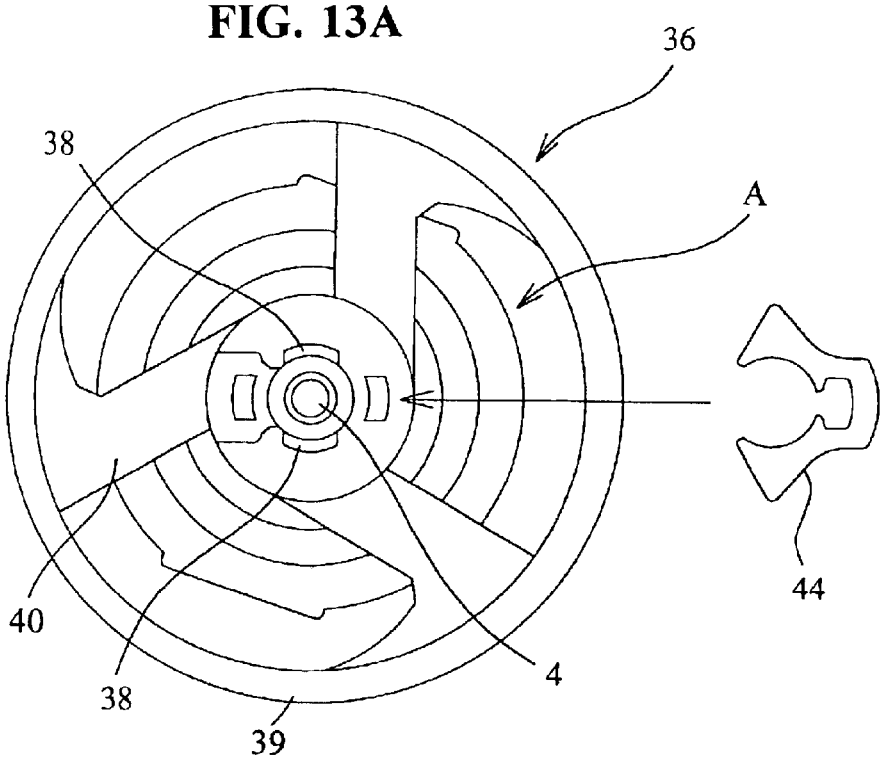
FIGS. 13A and 13B are explanatory diagrams showing a manner of fixing a rotating body.
Figure 13B:
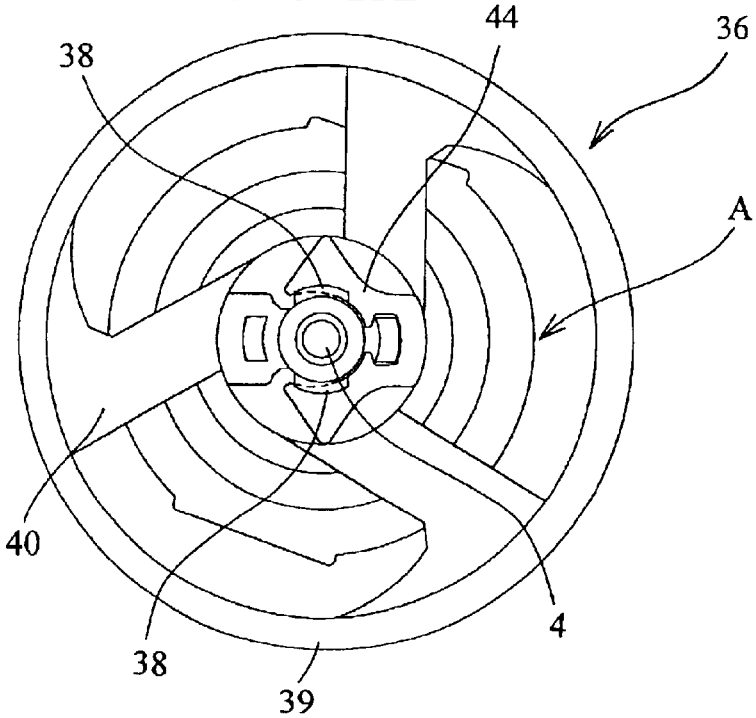

When the rotating body 36 is mounted to the toy body A, the engagement element 37 at the lower end of the revolving shaft 4 is inserted through the through holes 41 of the rotating body 36, and a side surface of the engagement element 37 is supported between inner surfaces of the supporting elements 42. Further, as shown in FIGS. 13A and 13B, a retaining ring 44 is inserted between rear surfaces of the fixing flanges 38 of the inserted engagement element 37 and a lower surface of the center of the rotating body 36 so that the rotating body 36 is fixed to the revolving shaft 4.

In the above structure, when a finger is inserted between the blade portions 40 of the rotating body 36 to revolve the rotating body 36, the revolving shaft 4 revolves so that the main spring (not shown) can be wound up. When the finger is removed from the rotating body 36, the main spring is released so that the revolving shaft 4 revolves reversely. The revolving direction of the revolving shaft 4 is the same as the revolving direction of the toy body A.

When the toy top having the above structure is used, the main spring of the toy body A is wound up as described above, and when a player revolves the toy top on the game board with the recessed center using a suitable shooter or the like, approximately simultaneously the player may release the main spring. Although the toy top revolves about the revolving shaft 4, simultaneously the revolving shaft 4 itself also revolves due to releasing of the main spring. However, since the rotating body 36 is mounted to the revolving shaft 4 which is revolved by the main spring, the revolving shaft 4 cannot revolve at high speed immediately due to a fly-wheel effect of the rotating body 36. The revolution of the revolving shaft 4 gradually rises. Moreover, since an inertia force is exerted, the revolution is in no hurry to stop but long-lasting. For this reason, when the revolving shaft 4 revolves, the revolving speed of the toy body A also rises, but a degree of the rise is slow, so that revolving characteristics such that the revolving force of the toy top increases gradually and the revolution of the toy top is in no hurry to stop due to inertia can be obtained.

When the toy top having the above structure as well as another toy top are revolved and struck against each other on the game board, since the ring portion 39 of the toy top having the above structure has a larger size than the toy body A, the competitor's toy top strikes against the protrusions 43 of the ring portion 39, so that the effect being that the chances of the toy top having the above structure beating the competitor's toy top become very good.

It is possible to set the time at which the revolving speed of the revolving shaft 4 peaks by adjusting a weight of the rotating body 36, a size of the ring portion 39 and/or the like.

In addition, although the revolving direction of the toy body A using the shooter is the same as the revolving direction of the revolving shaft 4 using the main spring in the above example, they may be revolved in opposite directions.

As can be seen from the foregoing, according to the present invention, the main spring power device is arranged inside the toy body and linked with the revolving shaft of the toy body so that the revolving shaft can be revolved by the force of the main spring, resulting in the revolving speed being quickened during the revolution of the toy top.

While preferred embodiments of the invention have been described with a certain degree of particularity with reference to the drawings, obvious modifications and variations are possible in light of the above teachings. It is therefor to be understood that within the scope of the appended claims, the invention may be practiced otherwise than as specifically described.

What is claimed is:

1. A toy top comprising:

a toy body;

a revolving shaft provided on a center of a bottom surface of said toy body so as to be rotatable; and a main spring power device arranged inside said toy body, said main spring power device being linked with said revolving shaft, wherein said main spring power device includes a latch unit for maintaining a winding-up position when a main spring is wound up and a button for releasing said latch unit so as to release a revolving force of said main spring; and said toy body includes a press mechanism for pressing said button according to a change of a centrifugal force during revolution of said toy body.

2. The toy top according to claim 1, wherein said button protrudes to an outside of said main spring power device; and said press mechanism includes a press member for pressing said button by utilizing the centrifugal force generated due to the revolution of said toy body, said press member being arranged in a position which surrounds said main spring power device.

3. The toy top according to claim 2, wherein said press member is arranged so as to be movable in a direction where said press member presses or separates from said button, and is urged by a spring in a direction where said press member separates from said button, to thereby press said button against a force of said spring due to a rise of the centrifugal force during the revolution of said toy body.

4. The toy top according to claim 2, wherein said press member is arranged so as to be movable in a direction where said press member presses or separates from said button, and is urged by a first spring in the direction where said press member presses said button; and said press mechanism further includes a holding member which is arranged so as to be movable between a position where said holding member is engaged with said press member and a position where said holding member is disengaged from said press member, and which is urged by a second spring so as to be engaged with said press member in a state that said press member separates from said button, and which is moved to the position where said holding member is disengaged from said press member against the force of said second spring due to the centrifugal force during the revolution of said toy body, whereby said press member disengages from said holding member and presses said button with the force of said first spring due to a reduction in the centrifugal force during the revolution of said toy body.

5. The toy top according to claim 1, wherein said revolving shaft includes a ring portion formed to have a larger size than said toy body.

* * * * *